US006336504B1

(12) United States Patent
Alhanati et al.

(10) Patent No.: US 6,336,504 B1
(45) Date of Patent: Jan. 8, 2002

(54) DOWNHOLE SEPARATION AND INJECTION OF PRODUCED WATER IN NATURALLY FLOWING OR GAS-LIFTED HYDROCARBON WELLS

(75) Inventors: Francisco Alhanati, Edmonton; Ryan Chachula, Calgary; Cam Matthews, Edmonton; Kelly Piers, Edmonton; Sandeep Solanki, Edmonton; Todd Zahacy, Edmonton, all of (CA)

(73) Assignee: Pancanadian Petroleum Limited, Calgary (CA)

( * ) Notice: Subject to any disclaimer, the term of this patent is extended or adjusted under 35 U.S.C. 154(b) by 0 days.

(21) Appl. No.: 09/519,391

(22) Filed: Mar. 3, 2000

(51) Int. Cl.[7] ..... E21B 43/38; E21B 43/40
(52) U.S. Cl. ..... 166/265; 166/105; 166/106; 166/313; 166/372
(58) Field of Search ..... 166/265, 313, 166/105, 106, 105.5, 372

(56) References Cited

U.S. PATENT DOCUMENTS

| | | | |
|---|---|---|---|
| 3,718,407 | A | 2/1973 | Newbrough |
| 4,251,191 | A | 2/1981 | Gass et al. |
| 4,386,654 | A | 6/1983 | Becker |

(List continued on next page.)

FOREIGN PATENT DOCUMENTS

| | | |
|---|---|---|
| GB | 2194575 | 3/1988 |
| GB | 2203062 | 10/1988 |
| GB | 2308995 | 7/1997 |
| WO | WO8603143 | 6/1986 |
| WO | WO9413930 | 6/1994 |
| WO | WO 95/07414 | 3/1995 |
| WO | WO 98/13579 | 4/1998 |
| WO | WO 00/03118 | 1/2000 |

OTHER PUBLICATIONS

Boothby, L. K., Garred, M. A. and Woods, J. P., Tenneco Oil Co. "Application of Hydraulic Jet Pump Technology on an Offshore Production Facility". Presented at the 63rd Annual Technical Conference and Exhibition, Houston, TX, Oct. 1988, SPE 18236, pp. 563–571.

Grupping, A. W. Coppes, J. L. R. and Groot, J. G. "Fundamentals of Oilwell Jet Pumping", SPE Publications Dept., Richardson, TX, Feb. 1988, SPE 15670, pp. 9–14.

Smart, E. E. "Jet Pump Geometry Selection", Southwestern Petroleum Short Course Association, Lubbock, Texas, 1985, pp. 427–441.

(List continued on next page.)

*Primary Examiner*—Hoang Dang
(74) *Attorney, Agent, or Firm*—Brian W. Gray

(57) ABSTRACT

A method and system for the downhole separation and injection of a predominately water component of the mixture produced from a naturally flowing or gas-lifted hydrocarbon well. The produced mixture is delivered to a separator located in the wellbore above an injection formation, the separator comprising a gas-liquid separator and an oil-water separator. The produced mixture is admitted to a gas-liquid separator to separate the free gas from the produced mixture. The gas-depleted produced mixture is then admitted to an oil-water separator where the produced mixture is separated into a predominately water component and a predominately hydrocarbon component. The separated gas and the predominately hydrocarbon component are delivered to the surface, separately or commingled. The predominately water is injected in the injection formation accessible through the same wellbore, and located below the separator. The predominately water component is separated at a sufficiently elevated location with respect to the injection formation to permit the predominately water component to be delivered to the injection formation under the force of gravity. This invention achieves downhole water separation and injection without having to install downhole pumps to re-inject the water contained in the produced mixture.

30 Claims, 3 Drawing Sheets

U.S. PATENT DOCUMENTS

| | | | | | |
|---|---|---|---|---|---|
| 4,770,243 | A | | 9/1988 | Fouillout et al. | |
| 4,793,408 | A | * | 12/1988 | Miffre | 166/53 |
| 4,805,697 | A | * | 2/1989 | Fouillout et al. | 166/265 |
| 5,217,067 | A | | 6/1993 | Landry et al. | |
| 5,296,153 | A | * | 3/1994 | Peachey | 210/787 |
| 5,456,837 | A | | 10/1995 | Peachey | |
| 5,482,117 | A | | 1/1996 | Kolpak et al. | |
| 5,570,744 | A | | 11/1996 | Weingarten et al. | |
| 5,711,374 | A | * | 1/1998 | Kjos | 166/265 |
| 5,730,871 | A | | 3/1998 | Kennedy et al. | |
| 5,813,469 | A | | 9/1998 | Bowlin | |
| 5,830,368 | A | | 11/1998 | Peachey | |
| 5,857,519 | A | * | 1/1999 | Bowlin et al. | 166/105.5 |
| 5,860,476 | A | | 1/1999 | Kjios | |
| 5,988,275 | A | | 11/1999 | Brady et al. | |
| 6,017,456 | A | | 1/2000 | Kennedy et al. | |
| 6,026,901 | A | * | 2/2000 | Brady et al. | 166/265 |
| 6,082,452 | A | * | 7/2000 | Shaw et al. | 166/105.5 |
| 6,089,317 | A | * | 7/2000 | Shaw | 166/265 |
| 6,092,600 | A | * | 7/2000 | McKinzie et al. | 166/266 |
| 6,138,758 | A | | 10/2000 | Shaw et al. | |
| 6,173,774 | B1 | | 1/2001 | Fox | |
| 6,189,613 | B1 | * | 2/2001 | Chachula | 166/265 |
| 6,202,744 | B1 | * | 3/2001 | Shaw | 166/106 |
| 6,213,208 | B1 | * | 4/2001 | Skilbeck | 166/265 |

OTHER PUBLICATIONS

International Search Report mailed Aug. 7, 2001 in connection with International Application No. PCT/CA01/00260.

International Search Report mailed Aug. 6, 2001 in connection with International Application No. PCT/CA01/00263.

* cited by examiner

DOWNHOLE SEPARATION AND INJECTION OF PRODUCED WATER IN NATURALLY FLOWING OR GAS-LIFTED HYDROCARBON WELLS

BACKGROUND OF THE INVENTION

1. Field of the Invention

The present invention is generally directed to a method and system for the downhole separation and injection of water contained in produced mixtures from a production zone of a hydrocarbon well.

2. Background

In many hydrocarbon wells, there is a high percentage of water (referred to as water cut) in the produced fluid mixture. In typical practice, the produced fluid is lifted to the surface and the water is separated from hydrocarbon at the surface. Surface separated water is subsequently treated and disposed of on the surface or re-injected into a subterranean formation for disposal or as part of an enhanced reservoir recovery program. This process is not always entirely satisfactory because of the energy needed to lift the water to surface, and costs involved in separation of the water and hydrocarbon fluid, and re-injection of the water.

In many cases, it might be more economical to separate the water downhole in the same wellbore and re-inject it into a suitable zone accessible through the same wellbore. Examples of methods for the downhole separation and re-injection of water contained in fluids produced from hydrocarbon wells have been described in the patent literature: WO86/03143, U.S. Pat. Nos. 4,805,697, 5,296,153, 5,456,837, 5,711,374, and 5,730,871. These approaches describe various means to achieve downhole separation of oil and water components of produced fluids with subsequent lifting of separated oil to the wellhead. These approaches rely on downhole pumps to re-inject the water component into a suitable zone, and to bring the oil to surface.

In order to drive a downhole pump, some form of power, be it mechanical, electrical or hydraulic, must be transmitted from surface to the pump. Hydrocarbon wells are often located in places where providing for power for such functions is not convenient.

In offshore wells, gas-lift systems are often preferred due to the simplicity and reliability of their associated downhole components. In such techniques, compressed gas is commingled downhole with the produced fluids, thereby reducing the density of the produced fluids until the weight of the column of the gasified fluids becomes less than the pressure exerted on the body of fluids in the well, and flow of produced fluids to the surface is facilitated. Examples of the gas-lift technique are described in U.S. Pat. Nos. 5,217,067, 4,251,191, and 3,718,407.

U.S. Pat. No. 5,857,519 describes an approach for the downhole disposal of the water component of produced fluids while using gas lift techniques to lift the oil component to the surface. The oil and water components are separated downhole by gravity in an annular space located between a production tubing and the wellbore casing. Pressurized gas is used to drive a downhole pump that re-injects downhole-separated water, and exhaust gas from the downhole pump is used to assist in the lifting of oil to the wellhead.

Using present technology, downhole separation and disposal of water in a wellbore require downhole pumps. The present technology is therefore, inherently plagued with two main problems: 1) complex completions associated with providing power from surface to drive downhole pumps, and 2) poor reliability of the downhole pumps.

SUMMARY OF THE INVENTION

What is required is a method and system for the downhole separation and injection of water contained in produced mixtures from hydrocarbon wells that does not require downhole pumps. Accordingly, the present invention concerns a method and system for separating and injecting downhole, the water contained in the produced mixture of a hydrocarbon well while lifting hydrocarbon contained in the produced mixture to surface without the use of a downhole pump.

According to an aspect of the present invention, there is provided a method for the downhole separation and injection of a predominately water component of a production fluid comprising at least some water and at least some oil from a production zone of a hydrocarbon well comprising the steps of separating downhole, at a position elevated with respect to an injection formation, the production fluid into a predominately water component and a predominately hydrocarbon component and delivering the predominately water component to the downhole injection formation, wherein the separating step is conducted at a sufficiently elevated location with respect to the injection formation to permit the predominately water component to be delivered to the downhole injection formation under the force of gravity. In accordance with a preferred embodiment of the invention, the method further comprises injecting gas into the production fluid to deliver the production fluid to the elevated position in the well. In another preferred embodiment, the injected gas is delivered downhole through a gas-lift string that extends from the head of the well.

In accordance with yet another preferred embodiment, the production fluid is delivered to the elevated position by way of a conduit that extends from the production formation to the elevated position. In accordance with yet another preferred embodiment, the production fluid is delivered to the elevated position by way of an annular space within the well.

In a preferred embodiment of the invention, the percentage of water in the production fluid is at least 20%.

In accordance with yet another preferred embodiment of the invention, the production fluid contains gas. In accordance with yet another preferred embodiment, gas is separated from the production fluid and this step optionally precedes the step of separating the production fluid into a predominately water component and a predominately hydrocarbon component. In yet another preferred embodiment of the invention, the separated gas is delivered to the surface.

In accordance with yet another preferred embodiment of the invention, the mostly hydrocarbon component is transported to the surface. In accordance with yet another preferred embodiment of the invention, the separated gas and the predominately hydrocarbon component are combined and delivered to the surface. In a preferred embodiment of the present invention, a mixing device is used to combine gas and the mostly hydrocarbon component of the production fluid.

In accordance with another aspect of the invention, there is provided a system for the downhole separation and injection of a predominately water component of a production fluid comprising at least some water and at least some oil from the production formation of a hydrocarbon well. The system comprises an oil-water separator located downhole at a position elevated with respect to an injection formation, a first passage to provide fluid communication between the production formation and an inlet of the separator, and a second passage to provide fluid communication between the water outlet of the separator and a downhole injection formation. The separator is located at a sufficiently elevated location with respect to the injection formation to permit the mostly water component emerging from the water outlet to be delivered to the downhole injection formation under the force of gravity.

In a preferred embodiment, the oil-water separator comprises at least one cyclone.

In another preferred embodiment of the present invention, the system further comprises means for injecting gas into the production fluid in order to deliver the production fluid to the separator such as a conduit extending between the head of the well and the production formation.

In yet another preferred embodiment, the system includes a gas-liquid separator located at an elevation at least as high as the oil-water separator and having a gas-liquid inlet in fluid communication with the production fluid for receiving the production fluid as well as an outlet for passage of liquid from the gas-liquid separator to the oil-water separator. In a preferred embodiment, the gas-liquid separator comprises at least one cyclone. In another preferred embodiment, the gas-liquid separator comprises at least one auger. In yet another preferred embodiment, the gas-liquid separator comprises a combination of at least one cyclone and at least one auger connected in series or in parallel. In yet another preferred embodiment, the cyclone incorporates a swirl generator.

In yet another preferred embodiment, the system includes a third passage that extends between the oil outlet of the oil-water separator and the head of the well.

In yet another preferred embodiment, the system includes means for injecting gas into the third passage to promote flow of the mostly hydrocarbon component of the production fluid from the oil outlet to the head of the well. Means can include a conduit for providing fluid communication between a gas outlet of the gas-liquid separator and the third passage.

In accordance with yet another aspect of the invention, there is provided a method of completing a well for production of hydrocarbon from an underground formation comprising installing an oil-water separator downhole at a position elevated with respect to the injection formation, providing a first passage for fluid communication between the production formation and an inlet of the separator, providing a second passage that is isolated from the first passage for fluid communication between the water outlet of the separator and the injection formation, and locating the separator at a sufficiently elevated location with respect to the injection formation to permit fluid emerging from the water outlet to be delivered to the downhole injection formation under the force of gravity.

In a preferred embodiment of the present invention, providing an oil-water separator comprises installing at least one cyclone.

In another preferred embodiment of the present invention, the method further comprises providing means for injecting gas into the production fluid in order to deliver the production fluid to the separator. In a preferred embodiment, a conduit extending between the head of the well and the production formation is provided to provide means for injecting gas.

In yet another preferred embodiment, the method further comprises providing a gas-liquid separator located at an elevation at least as high as the oil-water separator and having a gas-liquid inlet in fluid communication with the production fluid for receiving the production fluid as well as an outlet for passage of liquid from the gas-liquid separator to the oil-water separator. In a preferred embodiment, the gas-liquid separator comprises a cyclone. In another preferred embodiment, the gas-liquid separator comprises an auger.

In yet another preferred embodiment, the method further comprises providing a third passage that extends between the oil outlet of the oil-water separator and the head of the well.

In yet another preferred embodiment, the method further comprises providing means for injecting gas into the third passage to promote flow of the mostly hydrocarbon component of the production fluid from the oil outlet to the head of the well. Means include a conduit for providing fluid communication between a gas outlet of the gas-liquid separator and the third passage.

With the present method and system, there does not need to be a downhole pump to inject the downhole-separated water component of produced fluids. The separator is located in a position in the wellbore so as to produce the predominately water component at a sufficient pressure so that it may be injected downhole without the use of a pump. This variable position of the separator can also lead to a reduction in gas-lift requirements. The lower the injection pressure needed to inject the water, the lower the location of the separator which in turn results in reduced artificial lift requirements. Also, with the present system, the produced mixture can be lifted to the separator in either a dedicated tube or annular space. This arrangement leads to a variable tubing configuration for optimizing flow of fluids in the wellbore. Potential benefits include increased production rates in wells currently production limited due to existing tubular and surface facilities, reduction of water handling (both processing and disposal) at the surface, elimination of surface infrastructure for powering downhole pumps, reduced gas-lift usage, reductions in the cost of running high water cut hydrocarbon wells, improved system reliability and environmental benefits from reduced discharge of produced water. As well, gas separated from produced fluids downhole can be commingled and brought to surface with downhole separated oil to reduce tubing requirements in the well.

Other and further advantages and features of this invention will be apparent to those skilled in the art from the following detailed description thereof, taken in conjunction with the accompanying drawings.

BRIEF DESCRIPTION OF THE DRAWINGS

These and other features of the present invention are more fully set forth in the following description of illustrative embodiments of the invention. The description is presented with reference to the accompanying drawing in which:

FIG. 5*a* illustrates a gas-liquid separator that includes a cyclone with a combined swirl intake/gas outlet; FIG. 5*b* illustrates a gas-liquid separator that includes a cyclone with swirl intake and a gas segregation finder; FIG. 5*c* illustrates a gas-liquid separator that includes a cyclone with a combined swirl intake/gas outlet and an auger; and FIG. 5*d* illustrates a gas-liquid separator that includes a cyclone with a combined swirl intake/gas outlet and an auger, with the auger gas outlet extending into the combined swirl intake/gas outlet.

DETAILED DESCRIPTION OF PREFERRED EMBODIMENTS

The description which follows, and the embodiments described therein, are provided by way of illustration of an example, or examples of particular embodiments of the principles of the present invention. These examples are provided for the purpose of explanation, and not limitation, of those principles and of the invention. The examples include a description of the best mode of practising the invention currently known to the inventors.

Figure 1:
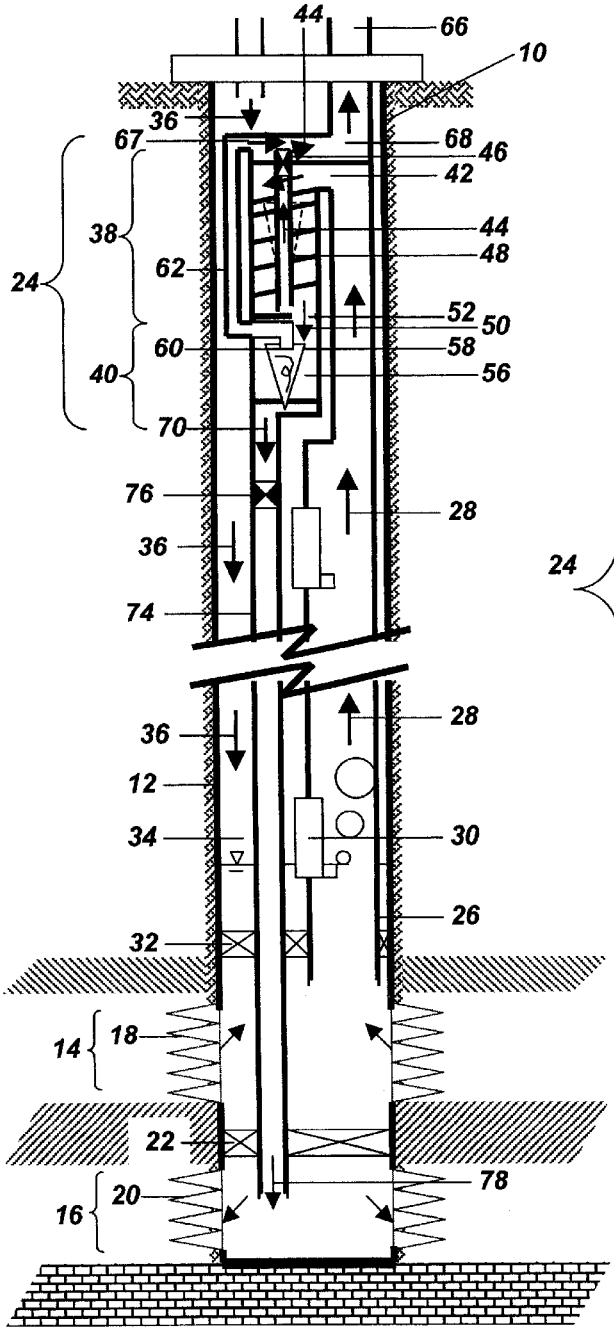
FIG. 1 is a schematic representation of an embodiment of the present invention in which the total produced mixture is delivered to a gas-liquid separator by way of a conduit extending from an underground production zone to the separator.
Figure 2:
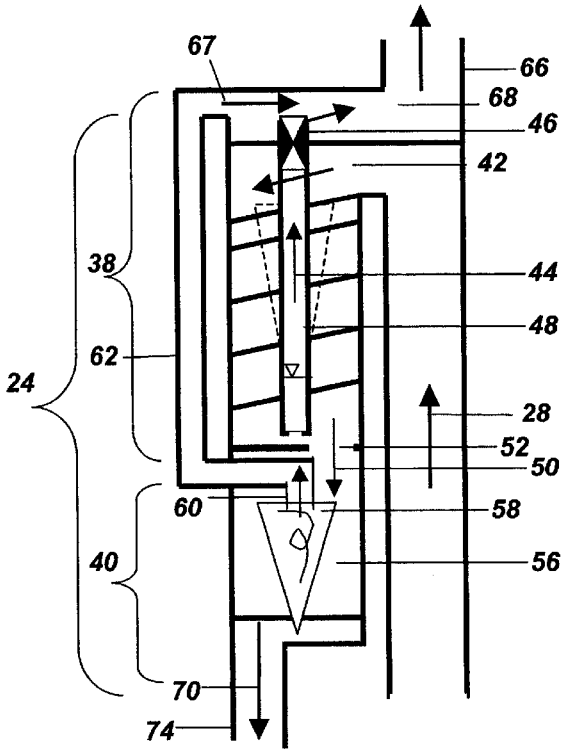
FIG. 2 is a schematic diagram of the gas-liquid separator and oil-water separator of the FIG. 1 embodiment.
Figure 3:
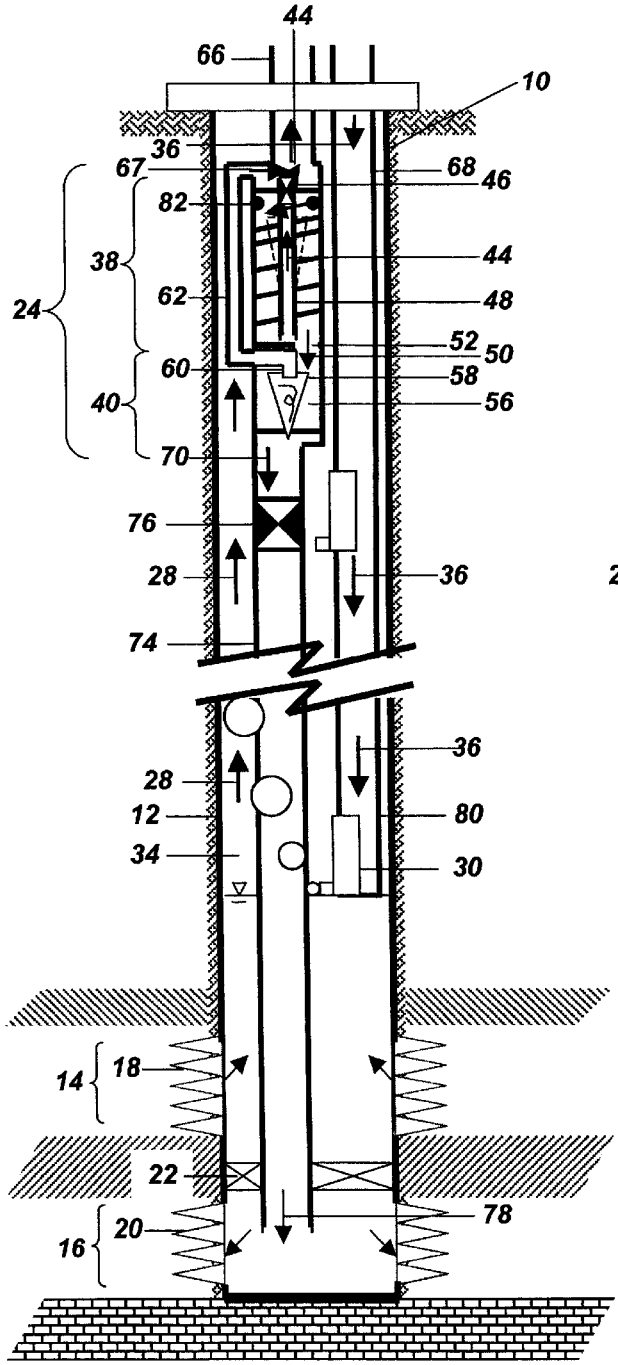
FIG. 3 is a schematic representation of an alternate embodiment of the present invention in which production fluid is delivered to the gas-liquid separator by way of an annular space located within the wellbore.
Figure 4:
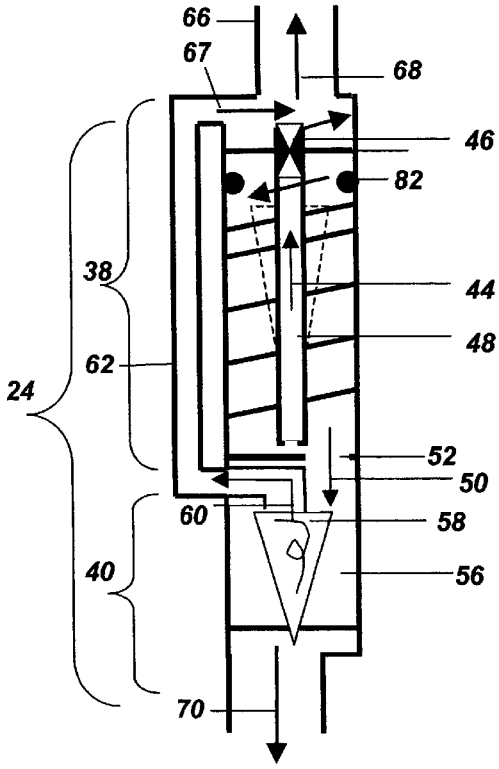
FIG. 4 is a schematic diagram of the gas-liquid separator and oil-water separator of the FIG. 3 embodiment.

With reference to FIG. 1 and FIG. 3, there is shown hydrocarbon production well 10 having wellbore casing 12 that penetrates at least one production formation 14 and at least one injection formation 16. Production perforations 18 in the wellbore casing are provided in the area of the production formation 14 to allow for inflow of the produced mixture from production formation 14. Injection perforations 20 in the wellbore casing are provided in the area of injection formation 16 to allow for injection of water into injection formation 16. Injection formation 16 may be above or below production formation 14. Lower annular sealing packer 22 isolates production formation 14 from injection formation 16. Separator 24, to separate water, gas and hydrocarbon contained in the produced mixture, is located within wellbore casing 12 above production formation 14. In FIGS. 1 through 4, separator 24 has been illustrated as a simple schematic and one skilled in the art can appreciate that the separator is more complicated. Also, in FIG. 1 and FIG. 3, separator 24 is located near the head of the well. In other embodiments, its location may be lower in the well. In other embodiments, its location may be higher in the well.

In FIG. 1, total production conduit 26 extends within wellbore casing 12 from production formation 14 to separator 24 for flow of the total produced mixture in the direction indicated by arrow 28. In this embodiment, gas-lift is provided through one or more gas-lift valves 30 spaced along the length of total production conduit 26 that extends into the wellbore to aid in lifting the produced mixture up the well. Alternative embodiments of the gas lift system will be apparent to those skilled in the art. For example, a continuous gas lift system may be used. An intermittent gas lift system may also be used. In wells where the eruptive force of the well is sufficient to lift the produced fluids up the well naturally, gas-lift may not be required. Upper annular sealing packer 32 isolates the production formation from annular space 34 in the well. Means for introducing lift gas (not shown), flowing in the direction indicated by arrows 36, is provided for on the surface. Separator 24 includes, in this embodiment, gas-liquid separator 38 and oil-water separator 40. Gas-liquid separator 38 reduces the fraction of free gas in the produced mixture entering oil-water separator 40. The produced mixture from the production formation can contain gas, oil and large amounts of water in the oil, as well as other impurities. In a preferred embodiment, there is a high water cut, for example 80% water cut, in the produced fluids. In other preferred embodiments, the water cut is higher or lower. This mixture flows from production formation 14 to separator 24, shown in FIG. 2, through total production conduit 26 and enters the upper portion of gas-liquid separator 38, through production fluid inlet 42. Accordingly, gas is separated from the total produced mixture by gas-liquid separators of the types shown schematically in FIGS. 5*a* to 5*d*, and free gas, travelling in the direction indicated by arrow 44, exits gas-liquid separator 38 through upper port 46 of gas collection conduit 48. Alternative embodiments of the gas-liquid separators illustrated in FIGS. 5*a* to 5*d* will be apparent to one skilled in the art. The gas-depleted produced mixture, travelling in the direction indicated by arrow 50, exits gas-liquid separator 38 through liquid outlet 52 and enters oil-water separator 40. Oil-water separator 40 includes separation chamber 56 wherein gas depleted production fluid is separated into a predominately hydrocarbon component and a predominately water component using cyclone separator 58. Alternative embodiments of the oil-water separator to separate the produced mixture into a predominately hydrocarbon component and a predominately water component will be apparent to one skilled in the art. For example, one or more cyclones can be housed in one or more separators, which, in turn, can act in series or in parallel, to separate produced fluids. The predominately hydrocarbon component, travelling in the direction indicated by arrow 60, exits separation chamber 56 and travels through oil concentrate conduits 62 which extend up the wellbore to conduit 66, which, in turn, extends to the head of the well. Gas collection string 48 is connected in this embodiment to conduit 62 through junction 68, so that free gas travelling in the direction indicated by arrow 44 and hydrocarbon travelling in the direction indicated by arrow 67 are lifted to the wellhead commingled. In another embodiment, a pressure drop device such as an orifice can be utilized to commingle the predominately hydrocarbon component and gas. The predominately water component, travelling in the direction indicated by arrow 70, exits oil-water separator 40 into water disposal string 74. Water disposal string 74, preferably equipped with adjustable downhole choke 76, passes through lower annular sealing packer 22 and extends from the bottom of separator 24 to injection formation 16. The predominately water component flows in the direction indicated by arrow 78, to injection formation 16.

In FIG. 3, another embodiment of this invention is disclosed. Elements previously described have been given the same reference number. The total produced mixture flows in the direction indicated by arrow 28, up the wellbore to separator 24 through annular space 34 located in the wellbore. In this embodiment, annular space 34 is formed between the casing of the well and water disposal string 74. Using an annular space for the flow of the produced mixture can allow for larger flow area and higher capacity that using a dedicated tubing for flow of the produced mixtures. Gas-lift string 80 traverses down the wellbore casing 12 from the head of the well to the lowest desired gas injection point. In this embodiment, the desired location is above the production formation. In general, the gas-lift string extends to a location below the wellhead but above the production formation. To assist in lifting total production fluid to separator 24, gas, flowing in the direction indicated by arrow 36, is provided through gas-lift string 80 having one or more gas-lift valves 30 spaced along the length of gas-lift string 80. Production fluid enters the upper portion of gas-liquid separator 38, shown in detail in FIG. 4, through one or more inlets 82. Accordingly, gas is separated from the total produced mixture by gas-liquid separators of the types shown schematically in FIG. 5. Free gas, flowing in the direction indicated by arrow 44, exits gas-liquid separator 38 through upper port 46 of gas collection string 48. The gas-depleted produced mixture, flowing in the direction indicated by arrow 50, exits gas-liquid separator 38 through liquid outlet 52 and enters oil-water separator 40 shown in FIG. 4. Oil-water separator 40 includes separation chamber 56 wherein the gas depleted produced mixture is separated into a predominately hydrocarbon component and a predominately water component using cyclone separator 58. Alternative embodiments of the oil-water separator to separate the produced mixture into a predominately hydrocarbon component and a predominately water component will be apparent to one skilled in the art. For example, one or more cyclones can be housed in one or more separators, which, in turn, can act in series or in parallel, to separate produced fluids. The predominately hydrocarbon component, flowing in the direction indicated by arrow 60, exits separation chamber 56 through oil concentrate conduits 62 which in turn extend up the wellbore to conduit 66, that extends to the surface. The predominately water component, flowing in the direction indicated by arrow 70, exits oil-water separator 40 into water disposal string 74. Water disposal string 74, preferably equipped with adjustable downhole choke 76, passes through lower annular sealing packer 22 and extends from the bottom of separator 24 to injection formation 16. Water flows in the direction indicated by arrow 78 to injection formation 16.

Figure 5D:
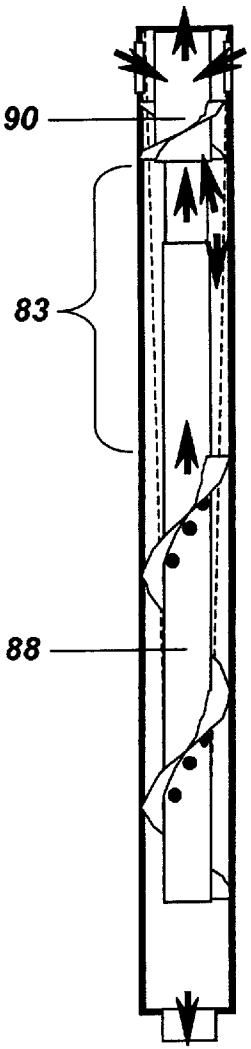
FIGS. 5*a* to 5*d* are more detailed schematic representations of types of gas-liquid separators illustrated in FIGS. 1 to 4.
Figure 5C:
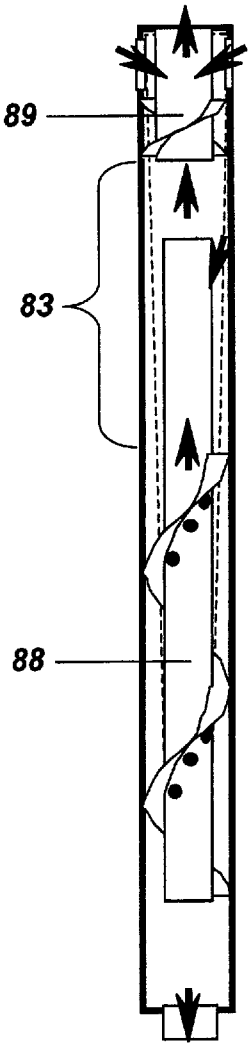
Figure 5B:
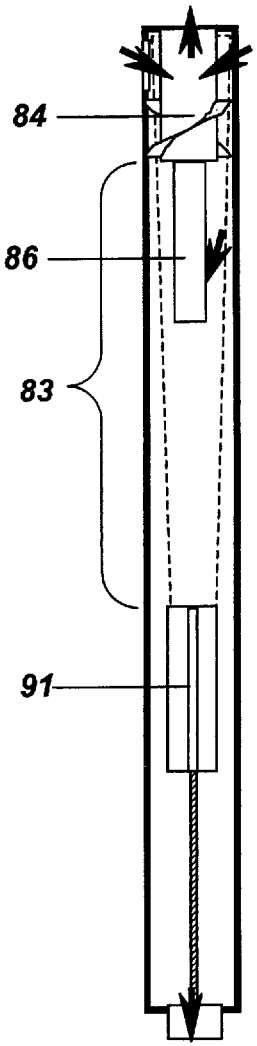
Figure 5A:
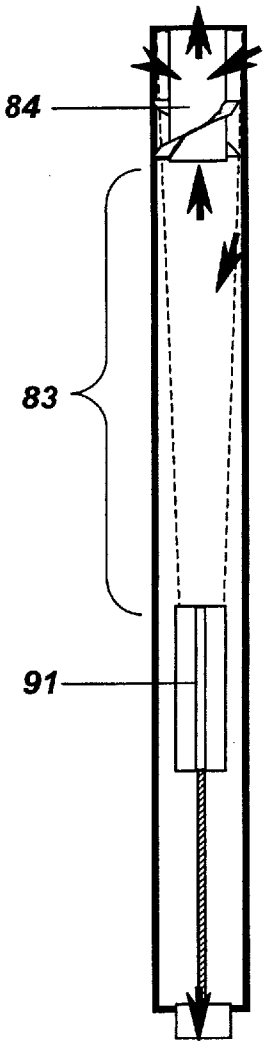

Referring now to FIGS. 5*a* to 5*d*, schematics of various types of the gas-liquid separator component of the present invention are shown. FIG. 5*a* shows the gas-liquid separator of the present invention which includes a cylindrical cyclone 83 with a combined swirl intake/gas outlet 84 and vortex breaker 91. FIG. 5*b* shows the gas-liquid separator of the present invention, which includes a cylindrical cyclone 83 with swirl intake 84, gas segregation finder 86 and vortex breaker 91. FIG. 5*c* shows the gas-liquid separator of the present invention, which includes cylindrical cyclone 83 and combined swirl intake/gas outlet 89 and auger 88. FIG. 5*d* shows the gas-liquid separator of the present invention which includes cyclone 83 with combined swirl intake/gas outlet 90, and auger 88, with the auger gas outlet extending into the combined swirl intake/gas outlet 90.

While the invention has been described with reference to certain embodiments, it is to be understood that the description is made only by way of example and that the invention is not to be limited to the particular embodiments described herein and that variations and modifications may be implemented without departing from the scope of the invention as defined in the claims hereinafter set out.

What is claimed is:

1. A method for the downhole separation and injection of a predominately water component of a production fluid comprising at least some oil and at least some water from a production formation of a hydrocarbon well, the method comprising the steps of:

(a) separating downhole, at a position elevated with respect to a downhole injection formation, the production fluid into a predominately water component and a predominately hydrocarbon component; and (b) delivering the predominately water component to the downhole injection formation, wherein;

(c) the separating step is conducted at a sufficiently elevated location with respect to the injection formation to permit the predominately water component of step (b) to be delivered to the downhole injection formation under the force of gravity;

wherein delivery of the production fluid to the elevated position is promoted by injecting gas into the fluid.

2. The method as recited in claim 1, wherein the percentage of water in the production fluid is at least 20%.

3. The method as recited in claim 1, wherein the production fluid contains gas, further comprising the step of:

(d) separating gas from the production fluid, and wherein: optionally, step (d) precedes step (a), and/or further comprising the step of delivering gas separated from the production fluid to the surface.

4. The method as recited in claim 1, further comprising the step of transporting the mostly hydrocarbon component to the surface.

5. The method as recited in claim 4, wherein gas lift is used to transport the mostly hydrocarbon component to the surface.

6. The method as recited in claim 3, further comprising the steps of:

(e) combining gas produced in step (d) and the predominately hydrocarbon component produced in step (a); and (f) delivering the combined mixture obtained in step (e) to the surface.

7. The method as recited in claim 6, wherein a mixing device is used to combine gas produced in step (d) and the predominately hydrocarbon component produced in step (a).

8. The method as recited in claim 1, wherein the production fluid is delivered to the elevated position of step (a) by way of a conduit extending from the production formation to the elevated position.

9. The method as recited in claim 1, wherein there is an annular space in the well, and the production fluid is delivered to the elevated position of step (a) through the annular space.

10. The method as recited in claim 1 wherein the injected gas is delivered downhole through a gas-lift string extending from the head of the well to a suitable downhole location.

11. A method for the downhole separation and injection of a predominately water component of a production fluid comprising at least some oil and at least some water from a production formation of a hydrocarbon well, the method comprising the steps of:

(a) injecting gas into the production fluid so as to lift the production fluid to a position in the wellbore that is elevated with respect to an injection formation;

(b) separating downhole, at the elevated position, gas from the production fluid;

(c) separating downhole, at the elevated position, the production fluid into a predominately water component and a predominately hydrocarbon component;

(d) delivering the predominately water component to the downhole injection formation, wherein;

(e) the separating steps are conducted at a sufficiently elevated location with respect to the injection formation to permit the predominately water component of step (c) to be delivered to the downhole injection formation under the force of gravity;

(f) transporting gas separated from the production fluid to the surface; and (g) transporting the mostly hydrocarbon component of the production fluid to the surface.

12. A system for the downhole separation and injection of a predominately water component of a production fluid comprising at least some oil and at least some water from a production formation of a hydrocarbon well, the system comprising:

(a) an oil-water separator located downhole at a position elevated with respect to an injection formation;

(b) a first passage extending between the production formation and an inlet of the separator to provide fluid communication therebetween; and (c) a second passage, isolated from the first passage, extending between a water outlet of the separator and the downhole injection formation to provide fluid communication therebetween; wherein:

(d) the separator is located at a sufficiently elevated location with respect to the injection formation to permit fluid emerging from the water outlet to be delivered to the downhole injection formation under the force of gravity; and (e) means for injecting gas into the production fluid for delivery thereof to the separator.

13. The system as recited in claim 12, further comprising a gas-liquid separator located at an elevation at least as high as the oil-water separator and located inline for receiving production fluid, the gas-liquid separator having a gas-liquid inlet in fluid communication with the first passage, for receiving production fluid therethrough, and a liquid outlet in fluid communication with the first passage, to permit flow of liquid from the gas-liquid separator to the oil-water separator.

14. The system as recited in claim 12 or 13, further comprising a third passage extending between an oil outlet of the oil-water separator and a head of the well.

15. The system as recited in claim 14, further comprising means for injecting gas into the third passage to promote flow of fluid from the oil outlet of the oil-water separator to the head of the well.

16. The system as recited in claim 15, wherein the means for injecting gas into the third passage comprises a conduit providing fluid communication between a gas outlet of the gas-liquid separator and the third passage.

17. The system as recited in claim 12, wherein the oil-water separator comprises at least one cyclone.

18. The system as recited in claim 13, wherein the oil-water separator comprises at least one cyclone.

19. The system as recited in claim 12, wherein the means for injecting gas into the production fluid comprises a conduit extending between a head of the well and a suitable location downhole.

20. The system as recited in claim 13, wherein the gas-liquid separator comprises a cyclone.

21. The system as recited in claim 13, wherein the gas-liquid separator comprises an auger.

22. A method of completing a well for the downhole separation and injection of a predominately water component of a production comprising at least some oil and at least some water fluid from a production formation of a hydrocarbon well, the method comprising:

(a) installing an oil-water separator downhole at a position elevated with respect to an injection formation;

(b) providing a first passage extending between the production formation and an inlet of the separator to provide fluid communication therebetween; and (c) providing a second passage, isolated from the first passage, extending between a water outlet of the separator and the injection formation of the well to provide fluid communication therebetween; wherein:

(d) the separator is located at a sufficiently elevated location with respect to the injection formation to permit fluid emerging from the water outlet to be delivered to the downhole injection formation under the force of gravity; and (e) means for injecting gas into the production fluid for delivery thereof to the oil separator.

23. The method as recited in claim 22, further providing a gas-liquid separator located at an elevation at least as high as the oil-water separator and located inline for receiving production fluid from the production formation, the gas-liquid separator having a gas-liquid inlet in fluid communication with the first passage, for receiving production fluid therethrough, and a liquid outlet in fluid communication with the first passage, to permit flow of liquid from the gas-liquid separator to the oil-water separator.

24. The method as recited in claim 22, further providing a third passage extending between an oil outlet of the oil-water separator and a head of the well.

25. The method as recited in claim 24, further providing means for injecting gas into the third passage to promote flow of fluid from the oil outlet of the oil-water separator to the head of the well.

26. The method as recited in claim 25, wherein providing the means for injecting gas into the third passage comprises installing a conduit for fluid communication between a gas outlet of the gas-liquid separator and the third passage.

27. The method as recited in claim 22, wherein providing the oil-water separator comprises installing at least one cyclone.

28. The method as recited in claim 22, wherein providing the means for injecting gas into the production fluid comprises installing a conduit which extends between a head of the well and a suitable location downhole.

29. The method as recited in claim 23, wherein providing the gas-liquid separator comprises installing a cyclone.

30. The method as recited in claim 23, wherein providing the gas-liquid separator comprises installing an auger.

* * * * *